US012077955B2

(12) United States Patent
Noonan et al.

(10) Patent No.: US 12,077,955 B2
(45) Date of Patent: Sep. 3, 2024

(54) FLOOR DRAIN/CLEANOUT PROTECTOR

(71) Applicant: Innovative Industries Inc., Roseneath (CA)

(72) Inventors: Michael John Edward Noonan, Roseneath (CA); John Arthur Hyma, Cobourg (CA); Brian Angus Read, Cobourg (CA)

(73) Assignee: Innovative Industries Inc., Roseneath (CA)

( * ) Notice: Subject to any disclaimer, the term of this patent is extended or adjusted under 35 U.S.C. 154(b) by 211 days.

(21) Appl. No.: 17/934,387

(22) Filed: Sep. 22, 2022

(65) Prior Publication Data

US 2023/0102254 A1 Mar. 30, 2023

Related U.S. Application Data

(60) Provisional application No. 63/247,833, filed on Sep. 24, 2021.

(51) Int. Cl.
*E03F 5/04* (2006.01)

(52) U.S. Cl.
CPC .... *E03F 5/0407* (2013.01); *E03F 2005/0413* (2013.01)

(58) Field of Classification Search
CPC ..... E03F 5/0407; E03F 2005/0413
USPC ..... 137/362
See application file for complete search history.

(56) References Cited

U.S. PATENT DOCUMENTS

| | | | | |
|---|---|---|---|---|
| 2018/0073237 | A1* | 3/2018 | Say | E03F 5/0407 |
| 2019/0119896 | A1* | 4/2019 | Priester | E03F 5/0407 |
| 2019/0242107 | A1* | 8/2019 | McLeod | E03F 5/06 |
| 2022/0298772 | A1* | 9/2022 | Young | E03F 5/0411 |

OTHER PUBLICATIONS

FinishLine Adjustable Drainage System, www.siouxchief.com, 2014, 20 pages.
Pronto! Adjustable Floor Drains and Cleanouts with Integrated Level, www.watts.com/pronto, 2020, 2 pages.

* cited by examiner

*Primary Examiner* — Kelsey E Cary
(74) *Attorney, Agent, or Firm* — DINSMORE & SHOHL LLP

(57) ABSTRACT

Certain embodiments provide a method of installing a floor drain/cleanout. The method generally includes positioning a drain/cleanout body comprising a first opening for receiving a finish drain/cleanout, disposing, on the drain/cleanout body, a cover base of a drain/cleanout cover assembly comprising a second opening for receiving the finish drain/cleanout, threading the finish drain/cleanout through the first opening and the second opening to retain the cover base on the drain/cleanout body, engaging an upper portion of the drain/cleanout cover assembly with the cover base of the drain/cleanout cover assembly, wherein engaging the upper portion with the cover base defines an enclosed void space above the finish drain/cleanout, installing a flooring material around at least the upper portion; removing the upper portion of the drain/cleanout cover assembly from the cover base of the drain/cleanout cover assembly to expose the void space, and positioning the finish drain/cleanout at a desired height.

15 Claims, 14 Drawing Sheets

FIG. 5A
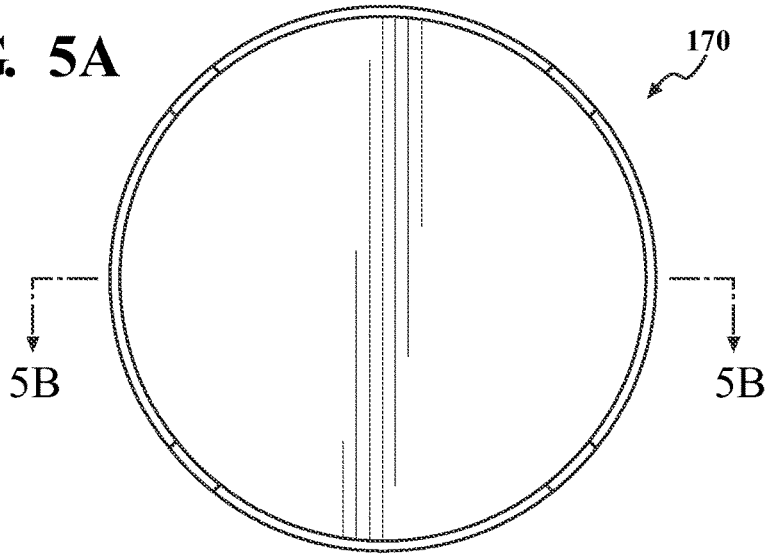
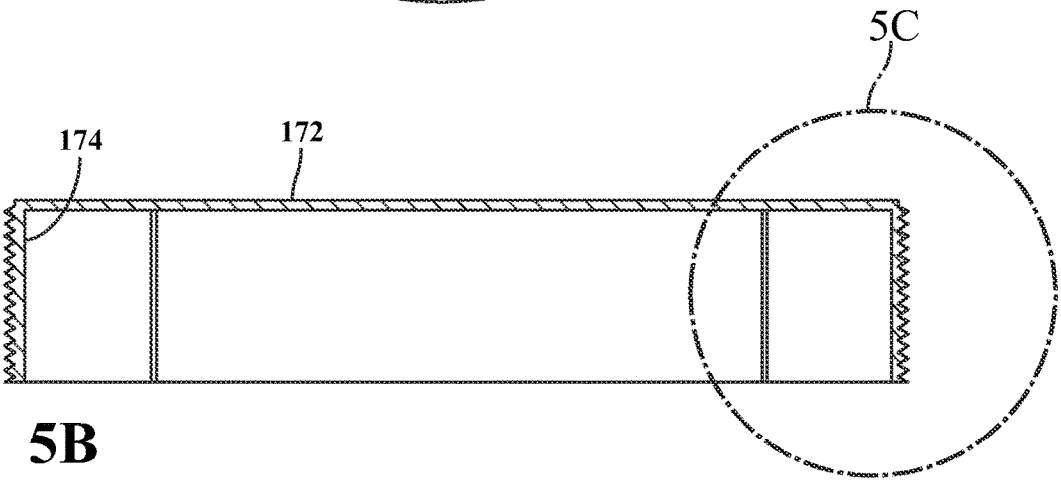
FIG. 5B
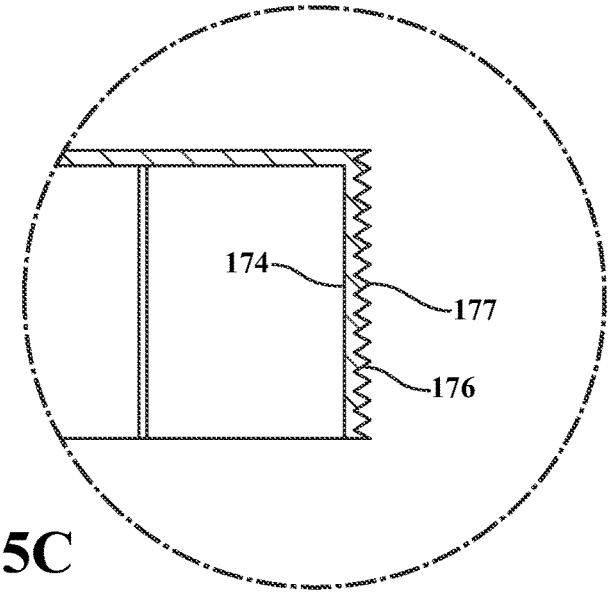
FIG. 5C

FIG. 6A
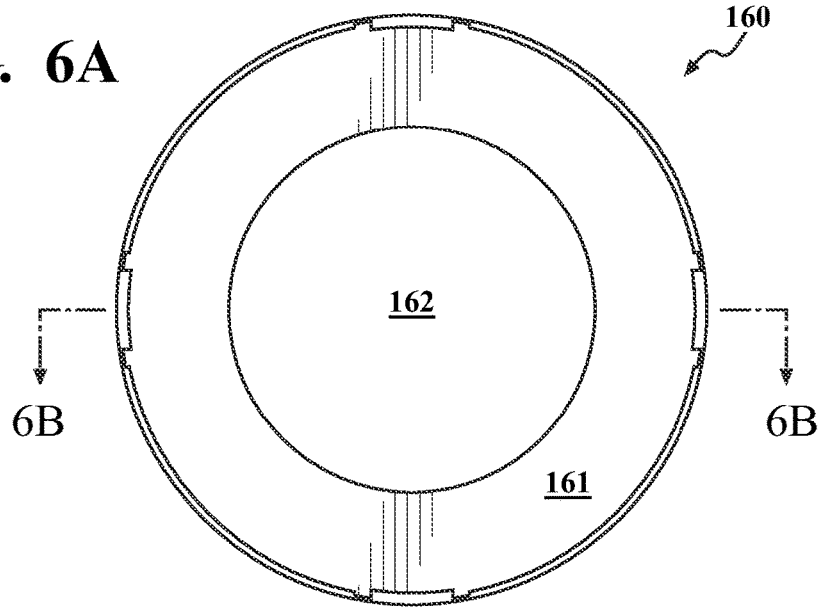
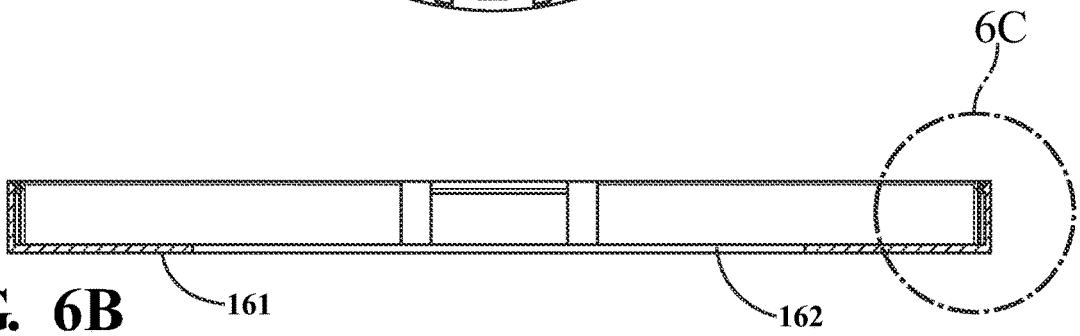
FIG. 6B
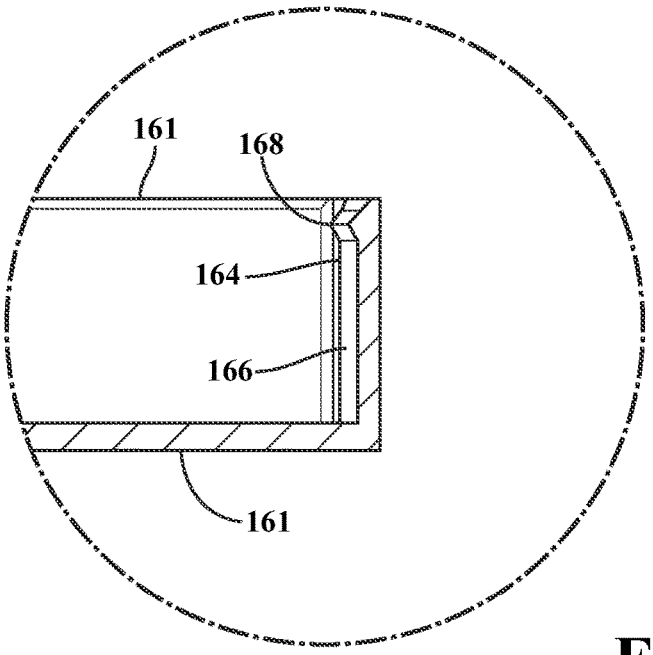
FIG. 6C

FLOOR DRAIN/CLEANOUT PROTECTOR

CROSS-REFERENCE TO RELATED APPLICATIONS

This application claims the benefit of and priority to U.S. Provisional Patent Application Ser. No. 63/247,833, entitled "Floor Drain/Cleanout Protector," filed Sep. 24, 2021, the contents of which is hereby incorporated by reference in its entirety.

INTRODUCTION

Aspects of the present disclosure relate to drains, cleanouts, and other utility inlet or outlet type fixtures installed in concrete slabs or floors, and, more particularly, to a method for installing such fixtures.

BACKGROUND

Floor drains and/or floor drain fixtures are generally installed in concrete slabs, such as concrete floors in warehouses, garages, basements, parking lots, commercial buildings, residential buildings, and/or the like, to accept water and/or other liquids from the top surface of the floor and provide a means for such liquids to flow into an underlying drain pipe. Further, floor drains generally include an opening inside the floor drain, commonly referred to as a cleanout, to allow access for removing blockages and/or other material from the drain pipe. Installation of such floor drains and cleanouts into a concrete floor, however, presents a number of challenges.

For example, a typical installation assembly includes a female threaded adaptor and/or connector that is attached to a vertically extending drain pipe. A floor drain, floor drain assembly, and/or cleanout with a threaded lower section is threaded into the adaptor. Concrete is then poured and finished around the drain/cleanout bodies. The finishing process often includes the use of power trowels. In particular, after the concrete is cured, it is often necessary to chip away the concrete from around the drain/cleanout bodies such that the drain/cleanout may be raised to its final finished height to allow for desired flooring to be installed, flush with the top of the drain/cleanout, and the installation may be finalized. This process is often time consuming.

SUMMARY

Certain embodiments provide a method of installing a floor drain/cleanout. The method generally includes positioning a drain/cleanout body comprising a first opening for receiving a finish drain/cleanout; disposing, on the drain/cleanout body, a cover base of a drain/cleanout cover assembly comprising a second opening for receiving the finish drain/cleanout, wherein a center of the second opening of the cover base is aligned with a center of the first opening of the drain/cleanout body; threading the finish drain/cleanout through the first opening and the second opening to retain the cover base on the drain/cleanout body; engaging an upper portion of the drain/cleanout cover assembly with the cover base of the drain/cleanout cover assembly, wherein engaging the upper portion with the cover base defines an enclosed void space above the finish drain/cleanout; installing a flooring material around at least the upper portion; removing the upper portion of the drain/cleanout cover assembly from the cover base of the drain/cleanout cover assembly to expose the void space; and positioning the finish drain/cleanout at a desired height.

The following description and the related drawings set forth in detail certain illustrative features of one or more embodiments.

DESCRIPTION OF THE DRAWINGS

The appended figures depict certain aspects of the one or more embodiments and are therefore not to be considered limiting of the scope of this disclosure.

FIGS. 5A-5C illustrate a detailed cross-sectional view of an upper portion of an example drain/cleanout cover assembly, according to aspects of the present disclosure;

FIGS. 6A-6C illustrate a detailed cross-sectional view of a cover base of an example drain/cleanout cover assembly, according to aspects of the present disclosure;

To facilitate understanding, identical reference numerals have been used, where possible, to designate identical elements that are common to the drawings. It is contemplated that elements and features of one embodiment may be beneficially incorporated in other embodiments without further recitation.

DETAILED DESCRIPTION

Aspects of the present disclosure provide a plumbing floor drain/cleanout cover assembly (subsequently referred to herein as a "drain/cleanout cover assembly" and/or "cover assembly") used for covering and protecting a floor drain/cleanout when installing flooring material. For example, the drain/cleanout cover assembly may be used to protect a drain/cleanout body and/or a finish drain/cleanout when pouring and finishing concrete around the drain/cleanout body and/or the finish drain/cleanout. As used herein, the term drain/cleanout is intended to be interpreted broadly enough to include cleanouts or cleanout assemblies, as well as drains or drain assemblies.

The drain/cleanout cover assembly described herein may include a cover base and an upper portion. Installation of the drain/cleanout cover assembly may include positioning the cover base of the drain/cleanout cover assembly on top of a drain/cleanout body and retaining the cover base on the drain/cleanout body using a finish drain/cleanout. The upper portion of the drain/cleanout cover assembly may then be positioned to engage the cover base and enclose the finish drain/cleanout for installation of a flooring material (e.g., concrete). The upper portion of the drain/cleanout cover assembly may be cut to a height, prior to engagement with the cover base, such that a top surface of the upper portion is at a desired level of the finished flooring material, thereby allowing the use of finishing tools and processes without disturbing the cover. After the flooring material is cured, the upper portion may be broken free and removed, thereby exposing the finish drain/cleanout. In certain aspects, the finish drain/cleanout is threaded into an opening of the drain/cleanout body, and after the upper portion of the drain/cleanout cover assembly is removed (e.g., after installing the flooring material), the finish drain/cleanout may be unscrewed and raised to a desired level/height to accommodate for finished desired flooring.

As such, aspects described herein provide an improvement over current methods for installing a floor drain/cleanout. In particular, use of the drain/cleanout cover assembly during installation reduces the effort necessary to chip away flooring material, such as concrete, poured around the drain/cleanout during installation. Instead, the drain/cleanout cover assembly encloses the drain/cleanout, as well as a void space above the drain/cleanout, prior to installation of the flooring materials such that after the flooring material is installed, removal of the drain/cleanout cover assembly allows for easier adjustment of the drain/cleanout to a desired height. The drain/cleanout cover assembly also serves to protect the drain/cleanout during installation. Accordingly, techniques described herein provide a more efficient and, in some cases, cost effective method for installing a floor drain/cleanout.

Figure 1:
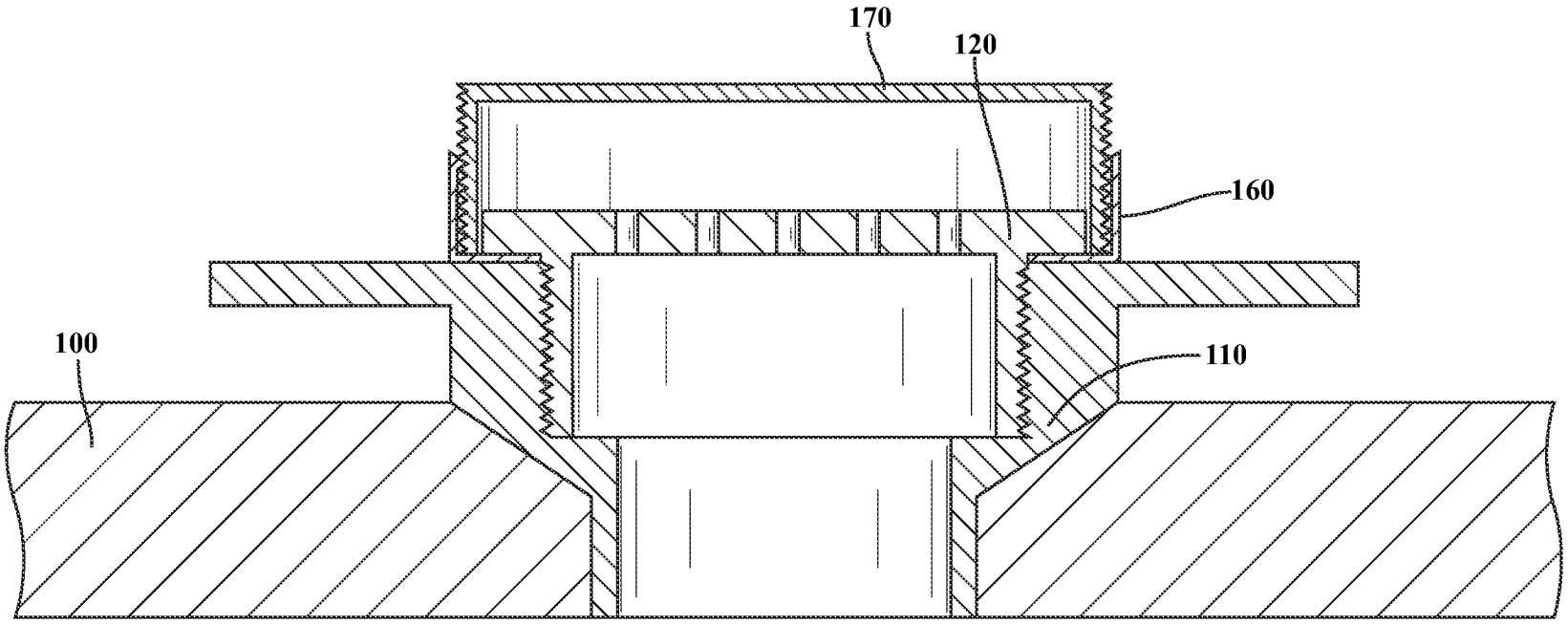
FIG. 1 illustrates an example plumbing floor drain/cleanout cover assembly used for covering and protecting a floor drain/cleanout when installing flooring material, according to aspects of the present disclosure.

FIG. 1 illustrates an example plumbing floor drain/cleanout cover assembly used for covering and protecting a floor drain/cleanout when installing flooring material, according to aspects of the present disclosure. As illustrated in FIG. 1, a finish drain/cleanout 120 is threaded into an opening of a drain/cleanout body 110 disposed in a floor 100 or positioned prior to floor installation. In certain aspects, floor 100 is a concrete floor, or the concrete floor may be poured after the assembly is positioned. Finish drain/cleanout 120 may include a top portion and a threaded portion (e.g., top portion 122 and threaded portion 124 illustrated in FIG. 8C). The threaded portion of finish/drain cleanout 120 may be threaded into the opening of drain/cleanout body 110 such that the upper portion of finish/drain cleanout 120 is at its lowest position, for example, adjacent to and in contact with an upper surface of drain/cleanout body 110.

Further, according to aspects described herein, a drain/cleanout cover assembly having an upper portion 170 and a cover base 160 (illustrated together as drain/cleanout cover assembly 150) may be used to cover and protect finish drain/cleanout 120 during installation of flooring material around drain/cleanout body 110 and finish drain/cleanout 120. Details of the drain/cleanout cover assembly design are provided in FIGS. 2-6.

Figure 2:
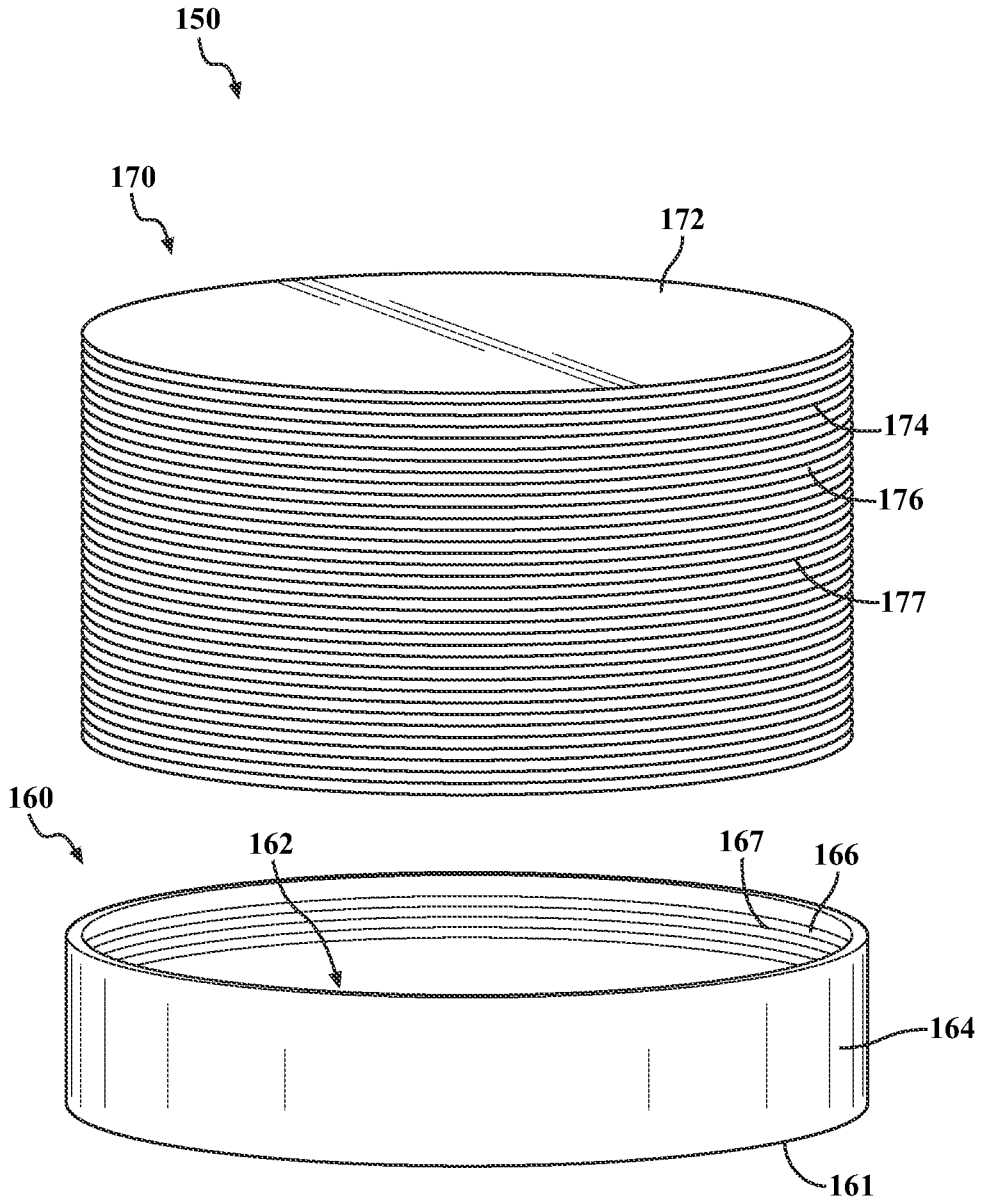
FIG. 2 illustrates an example cover base and upper portion that make up the floor drain/cleanout cover assembly introduced in FIG. 1, according to aspects of the present disclosure.

FIG. 2 illustrates an example cover base 160 and upper portion 170 which make up the floor drain/cleanout cover assembly 150 introduced in FIG. 1, according to aspects of the present disclosure. As illustrated, upper portion 170 includes a generally flat, top surface 172 and a side wall 174 (referred to herein as the "second side wall") around a perimeter of top surface 172 that extends vertically downward from top surface 172. On the other hand, cover base 160 includes a generally flat, bottom surface 161 and a side wall 164 (referred to herein as the "first side wall") around a perimeter of bottom surface 161 that extends vertically upward from bottom surface 161. Upper portion 170 and cover base 160 may be hollow.

In certain aspects, top surface 172 of upper portion 170 and/or bottom surface 161 of cover base 160 are generally round. In certain aspects, side wall 174 of upper portion 170 and/or side wall 164 of cover base 160 are generally cylindrical.

According to aspects described herein, at least a portion of an outer surface 176 of side wall 174 of upper portion 170 may be configured to engage and interconnect with at least a portion of an inner surface 166 of side wall 164 of cover base 160. For example, in certain aspects, upper portion 170 may include a plurality of circumferential grooves 177 extending along at least a portion of outer surface 176 of side wall 174. The plurality of circumferential grooves 177 may be configured to engage at least a portion of an inner surface 166 of side wall 164 of cover base 160. In certain aspects, the plurality of circumferential grooves 177 of upper portion 170 may be configured to engage a plurality of circumferential grooves 167 extending along at least apportion of inner surface 166 of side wall 164 of cover base 160. In certain aspects, upper portion 170 may be pushed and/or tapped into cover base 160 to engage and interconnect the two pieces.

Figure 3:
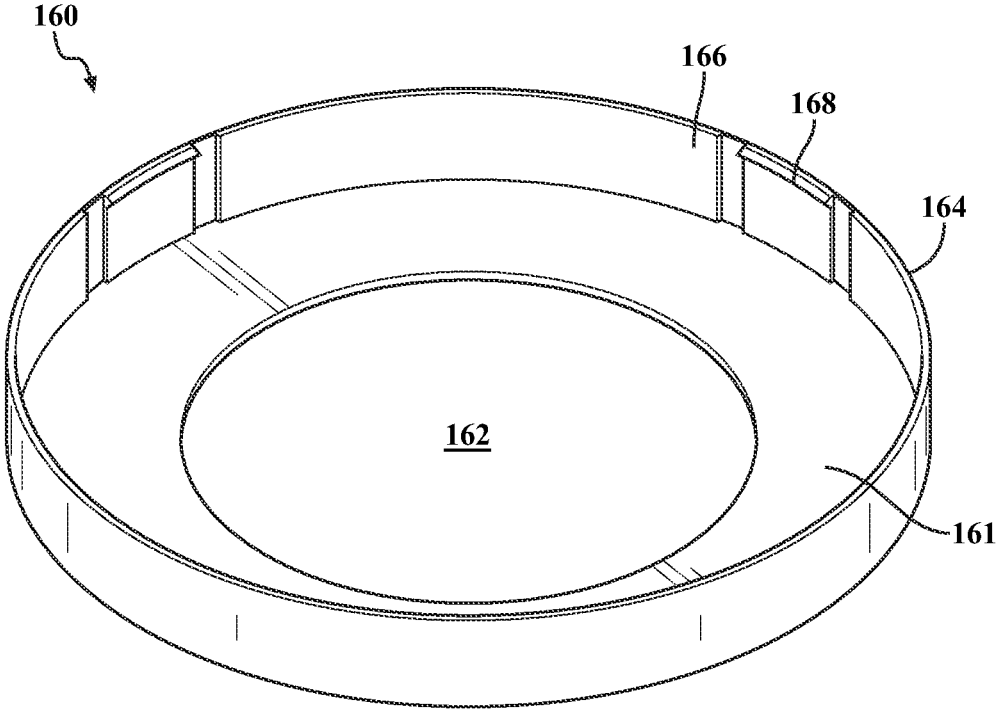
FIG. 3 is a perspective view an example cover base of the floor drain/cleanout cover assembly, according to aspects of the present disclosure.
Figure 4:
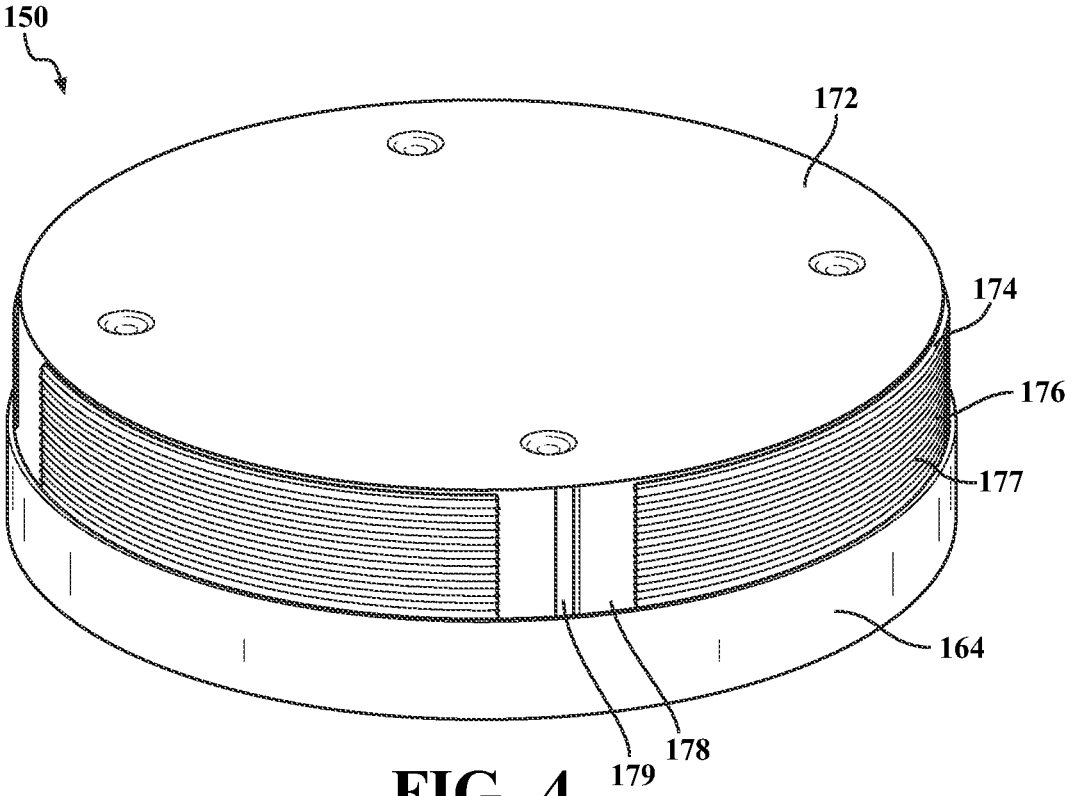
FIG. 4 is a perspective view of a drain/cleanout cover assembly with an upper portion of the drain/cleanout cover assembly engaging a cover base of the floor drain/cleanout cover assembly, according to aspects of the present disclosure.

In certain other aspects, engaging upper portion 170 of drain/cleanout cover assembly 150 with cover base 160 of drain/cleanout cover assembly 150 includes engaging at least one protrusion (e.g., tooth) extending inwardly from inner surface 166 of side wall 164 of cover base 160 with at least one groove of the plurality of circumferential grooves 177 of side wall 174 of upper portion 170. FIGS. 3 and 4 illustrate such engagement of upper portion 170 with cover base 160.

FIG. 3 is a perspective view an example cover base 160 of drain/cleanout cover assembly 150, according to aspects of the present disclosure. FIG. 4 is a perspective view of drain/cleanout cover assembly 150 with upper portion 170 of drain/cleanout cover assembly 150 engaging at least one protrusion (e.g., tooth) of cover base 160 of drain/cleanout cover assembly 150, according to aspects of the present disclosure.

As illustrated in FIG. 3, in certain aspects, cover base 160 includes at least one tooth 168 for engagement with upper portion 170. Each tooth 168 may extend inwardly from inner surface 166 of side wall 164 of cover base 160. Further, as illustrated in FIG. 4, in certain aspects, upper portion 170 includes one or more relieved areas/portions of outer surface 176 of side wall 174 where circumferential grooves 177 are not formed. In particular, relieved areas 178 are smooth portions of outer surface 176 of side wall 174. In certain aspects, relived areas 178 extend the entirety of the height of side wall 174.

Relieved areas 178 may allow for easier adjustment of height and rotation of upper portion 170 with respect to cover base 160 to engage at least one tooth 168 of cover base 160 with at least one groove 177 of upper portion 170. For example, in use, teeth 168 of cover base 160 may be aligned with relieved portions 178 of upper portion 170 such that upper portion 170 may be inserted into cover base 160. A width of each tooth 168 aligned with a corresponding relieved portion 178 may have a width that is less than or equal to a width of the corresponding relived portion 178 such that when each tooth 168 is aligned with its corresponding relieved portion 178, each tooth 168 is able to pass through the corresponding relieved portion 178. In other words, this allows upper portion 170 to be freely inserted into the interior of cover base 160. Each tooth 168 and relieved portion 178 pair may have the same or different dimensions as another tooth and relieved portion 178 pair. In certain aspects, teeth 168 are equally spaced around the circumference of side wall 164 of cover base 160 and relieved portions 178 are equally spaced around the circumference of side wall 174 of upper portion 170.

After upper portion 170 is inserted into the interior of cover base 160 (where outer surface 176 of upper portion 170 is adjacent to inner surface 166 of cover base 160), upper portion 170 may be rotated about a vertical axis until at least one tooth 168 of cover base 160 engages with the at least one groove 177 of upper portion 170. Accordingly, upper portion 170 may engage and interconnect with cover base 160. In certain aspects, engaging and/or interconnecting upper portion 170 with cover base 160 defines an enclosed void space between bottom surface 161 of cover base 160 and top surface 172 of upper portion 170. Further, as described below, in certain aspects, engaging and/or interconnecting upper portion 170 with cover base 160 protects a finish drain/cleanout 120 threaded into opening 162 of cover base 160.

As an illustrative example, upper portion 170 may have four relieved areas 178 equally spaced about the circumference of side wall 174, and cover base 160 may have four teeth 168 that are also equally spaced about the circumference of side wall 164. To engage upper portion 170 with cover base 160, a center (e.g., vertical axis) of upper portion 170 may be aligned with a center (e.g., vertical axis) of cover base 160. Upper portion 170 may then be rotated about its vertical axis until each relieved portion 178 aligns with each corresponding tooth 168. Subsequently, each tooth 168 may pass through its corresponding relived portion 178, and upper portion 170 may be rotated such that one or more of teeth 168 rotated into grooves 177 of upper portion 170 thereby securing them to one another.

In certain aspects, upper portion 170 may subsequently be removed from cover base 160. As such, this process may be reversed for removal.

In certain aspects, alternative to first aligning upper portion 170 with cover base 160 prior to engaging upper portion 170 with cover base 160, upper portion 170 may be pushed and/or tapped into cover base without aligning teeth 168 of cover base 160 with relieved areas 178 of upper portion 170.

In use, upper portion 170 may be cut to a desired height and then inserted into cover base 160 such that at least one tooth 168 engages at least one of grooves 177. In certain aspects, upper portion 170 is pushed or tapped downwardly until a bottom side of side wall 174 (opposite top surface 172 of upper portion 170) contacts bottom surface 161 and bottoms out. In cases where upper portion 170 is cut to the correct dimension for a finished floor height, bottoming upper portion 170 in cover base 160 may achieve the desired height.

Further, in certain aspects, upper portion 170 and/or cover base 160 may have thinned areas in the side walls (e.g., side wall 174 and/or side wall 164, respectively) to allow for some flexibility in the side walls. As known to those of skill in the art, molded plastic parts may slightly distort and/or may be slightly undersized or oversized, thereby making it difficult for two parts (e.g., the upper portion 170 and the cover base 160) to engage. As illustrated in FIG. 4, a thinned area 179 may be seen in relieved area 178 of upper portion 170. In certain aspects, thinned area 179 may act like a living hinge to provide some flexibility for engaging upper portion 170 with cover base 160.

FIGS. 5A-5C illustrate a detailed cross-sectional view of upper portion 170 of an example drain/cleanout cover assembly 150, according to aspects of the present disclosure. In particular, FIG. 5A is a plan view of upper portion 170, FIG. 5B is a cross sectional view of upper portion 170 taken along lines 5B-5B of FIG. 5A, and FIG. 5C is a detailed view of a portion of the cross section indicated at 5C in FIG. 5B.

As mentioned herein, upper portion 170 includes a closed top surface 172 and a generally cylindrical side wall 174 extending downwardly from top surface 172. Side wall 174 has an outer surface 176 with a plurality of grooves 177 defined therein. As shown in FIG. 5C, grooves 177 may be closely spaced. In certain aspects, grooves 177 are spaced apart by 0.063 inches. Other spacings may also be considered. In certain aspects, upper portion 170 is cut to a desired height by cutting along one of the grooves 177 around the entirety of upper portion 170. In certain aspects, grooves 177 of upper portion 170 are not threads, but are instead equidistant from top surface 172 around an entirety of side wall 174.

FIGS. 6A-6C illustrate a detailed cross-sectional view of cover base 160 of an example drain/cleanout cover assembly 150, according to aspects of the present disclosure. In particular, FIG. 6A is a plan view of cover base 160, FIG. 6B is cross sectional view of cover base 160 taken along lines 6B-6B of FIG. 6A, and FIG. 6C is a detailed view of a portion of the cross section indicated at 6C in FIG. 6B.

As mentioned herein, cover base 160 includes a bottom surface 161 with an opening 162. A generally cylindrical side wall 164 extends upwardly from bottom surface 161. Side wall 164 of cover base 160 has an inner surface 166 with at least one engagement tooth 168 extending inwardly therefrom.

Example Method for Installing a Floor Drain/Cleanout

Figure 7:
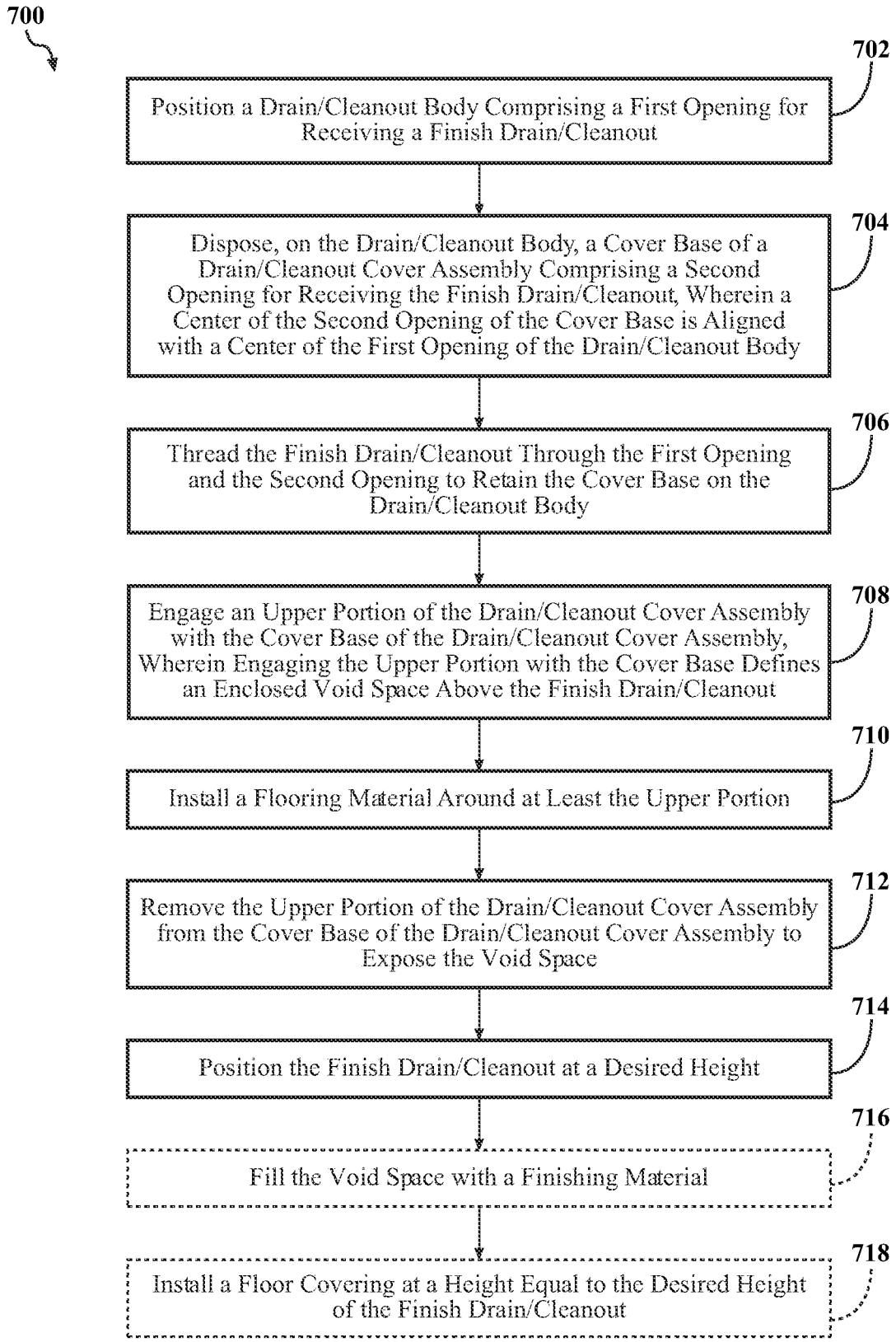
FIG. 7 illustrates example operations for installing a floor drain/cleanout, according to aspects of the present disclosure.

FIG. 7 illustrates example operations 700 for installing a floor drain/cleanout, according to aspects of the present disclosure. In particular, operations 700 introduce the use of a drain/cleanout cover assembly 150 (as described above) when installing a floor drain/cleanout. Drain/cleanout cover assembly 150 may be used to enclose the drain/cleanout, as well as a void space above the drain/cleanout, prior to installation of flooring materials such that after flooring materials are installed, removal of drain/cleanout cover assembly 150 allows for easier adjustment of the drain/cleanout to a desired height. The drain/cleanout cover assembly also serves to protect the drain/cleanout during installation. For purposes of explanation, operations 700 may be described with respect to FIGS. 8A-8H. FIGS. 8A-8H provide example illustrations for each of operations 700 illustrated in FIG. 7, according to aspects of the present disclosure.

Figure 8A:
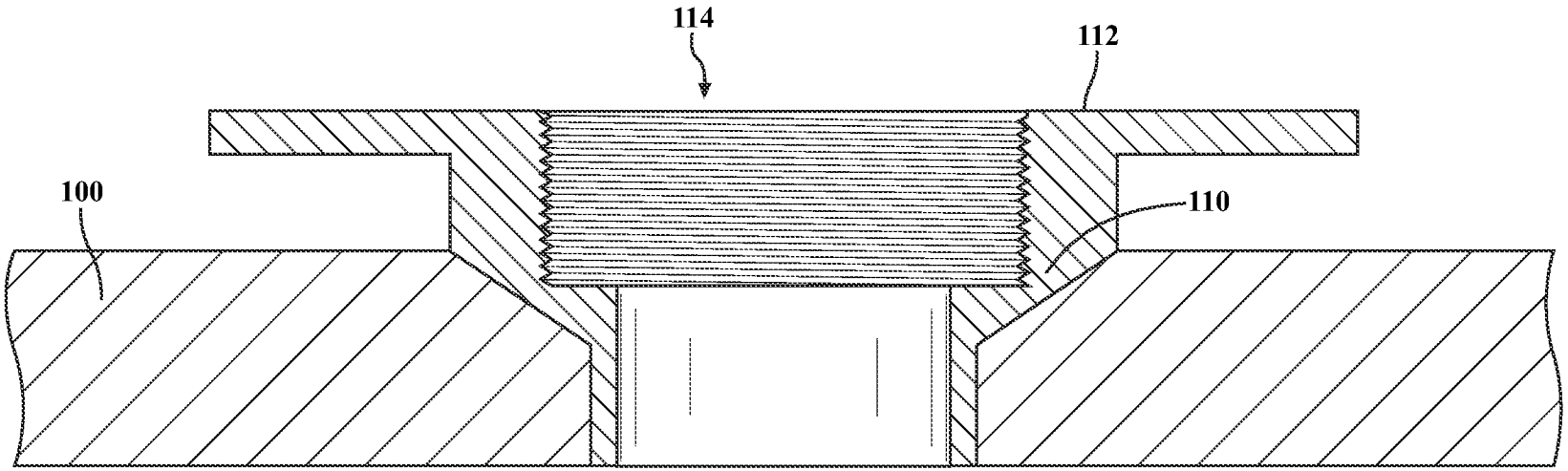
FIGS. 8A-8H provide example illustrations for the operations illustrated in FIG. 7, according to aspects of the present disclosure.

As illustrated, operations 700 begin, at block 702, by positioning a drain/cleanout body comprising a first opening for receiving a finish drain/cleanout. For example, as illustrated in FIG. 8A, drain/cleanout body 110 may be positioned in floor 100 prior to pouring surrounding flooring material (e.g., concrete). Drain/cleanout body 110 may be positioned in an entirely new floor in a repair. Drain/cleanout body 110 may have an upper surface 112 and a first opening 114 for receiving a finish drain/cleanout 120 (not illustrated).

Figure 8B:
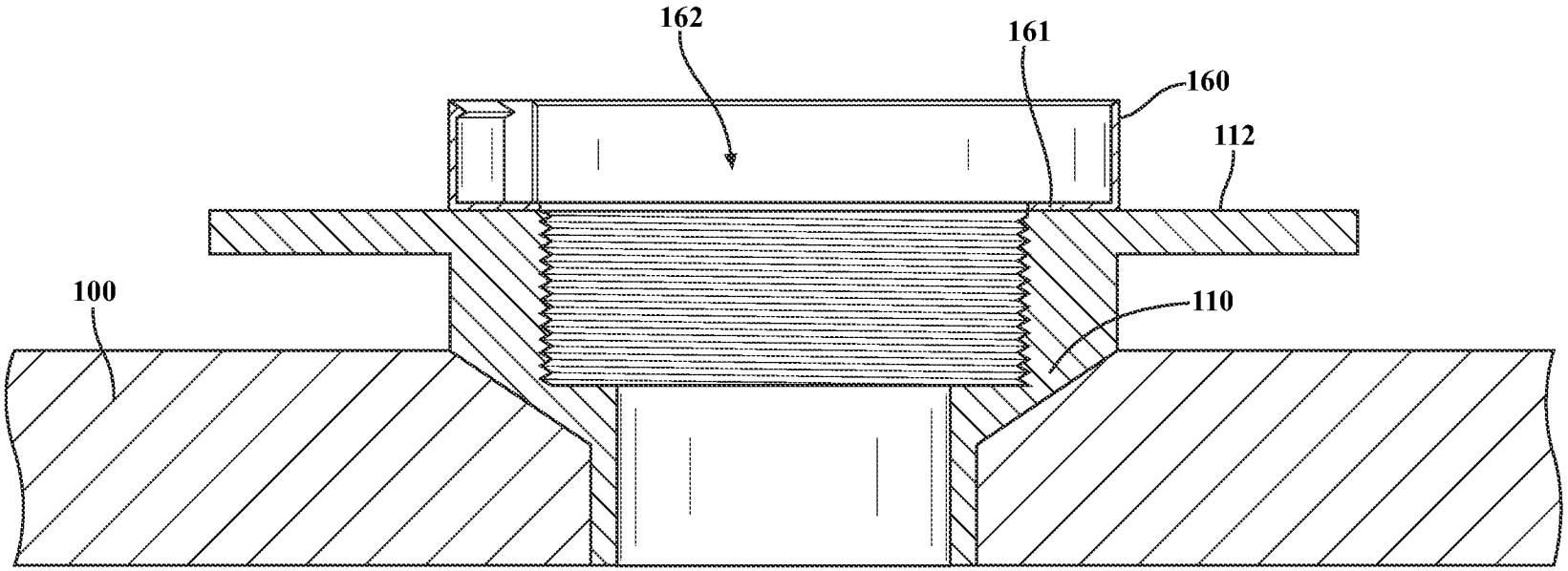

At block 704, operations 700 proceed with disposing, on the drain/cleanout body, a cover base of a drain/cleanout cover assembly comprising a second opening for receiving the finish drain/cleanout, wherein a center of the second opening of the cover base is aligned with a center of the first opening of the drain/cleanout body. For example, as illustrated in FIG. 8B, a cover base 160 may be disposed on upper surface 112 of drain/cleanout body 110, and more specifically, with bottom surface 161 of cover base 160 abutting upper surface 112 of drain/cleanout body 110. A vertical axis of second opening 162 of cover base 160 may be aligned with a vertical axis of first opening 114 of drain/cleanout body 110 when disposing cover base 160 on drain/cleanout body 110.

Figure 8C:
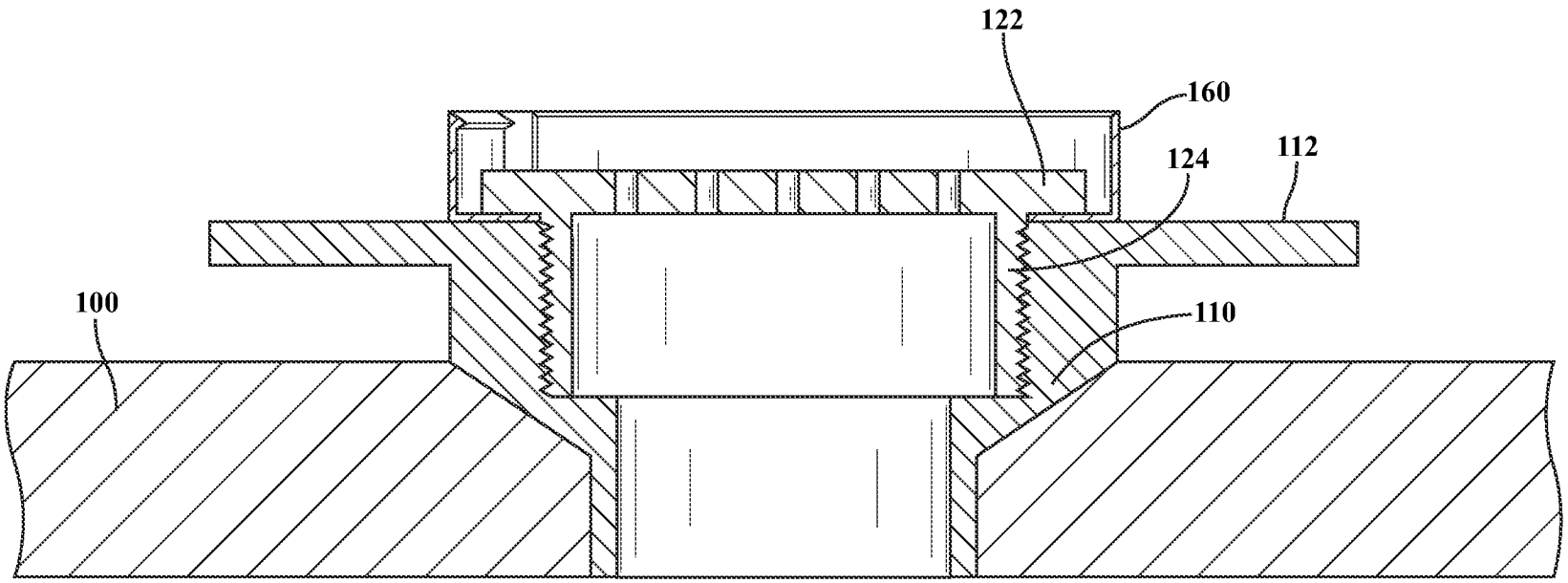

Alternatively, in certain aspects, the drain/cleanout body 110 may include cover base 160 integrated therewith and/or connected thereto, such as by having the side wall of cover base 160 extending upwardly therefrom At block 706, operations 700 proceed with threading a finish drain/cleanout through the first opening and the second opening to retain the cover base on the drain/cleanout body. For example, as illustrated in FIG. 8C, a finish drain cleanout 120 may have a top portion 122 and a threaded portion 124. Top portion 122 may span a first distance. Threaded portion 124 may be generally cylindrical and span a second distance, where the second distance is less than the first distance. Further, threaded portion 124 may extend vertically downward from top portion 122. Threaded portion 124 may be threaded through second opening 162 of cover base 160 and first opening 114 of drain/cleanout body 110 to retain cover base 160 on drain/cleanout body 110. Threaded portion 124 may be threaded through second opening 162 and first opening 114 until a bottom surface of top portion 122 comes in contact with (e.g., is adjacent to and touches) a top side of a bottom surface 161 of cover base 160. Accordingly, bottom surface 161 may be secured/retained on upper surface 112 of drain/cleanout body 110 at this point. Alternatively, cover base 160 may be held in position in other ways.

Figure 8D:
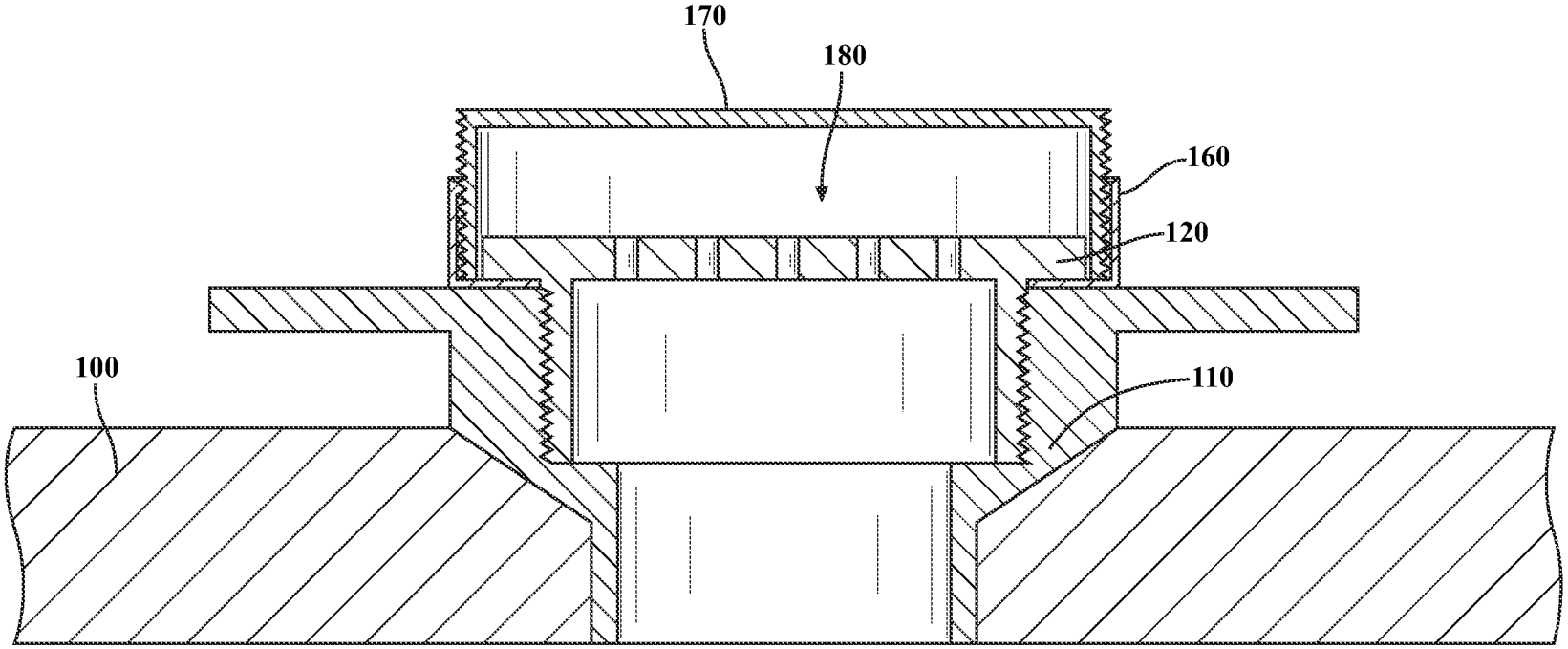

At block 708, operations 700 proceed with engaging an upper portion of the drain/cleanout cover assembly with the cover base of the drain/cleanout cover assembly, wherein engaging the upper portion with the cover base defines an enclosed void space above the finish drain/cleanout. For example, as illustrated in FIG. 8D, at least a portion of an outer surface of a side wall of upper portion 170 may engage at least a portion (e.g., all of) an inner surface of a side wall of cover base 160. As described above, in certain aspects, if upper portion 170 includes grooves, the grooves may be used to engage upper portion 170 with cover base 160. In certain aspects, if upper portion 170 has grooves and at least one relieved area and cover base 160 has at least one tooth, engaging upper portion 170 with cover base 160 may include (1) aligning the at least one tooth with the at least one relieved area, (2) engaging upper portion 170 with cover base 160, and (3) rotating upper portion 170 relative to cover base 160 to engage the at least one tooth with the at least one groove. At this point, finish drain/cleanout 120, if used to retain cover base 160, is enclosed and protected by upper portion 170. Engaging upper portion 170 with cover base 160 also defines an enclosed void space 180 above finish drain/cleanout 120.

In certain aspects, prior to engaging upper portion 170 with cover base 160, upper portion 170 may be cut to a desired height. The desired height may be a height desired for the floor when flooring material is installed.

Figure 8E:
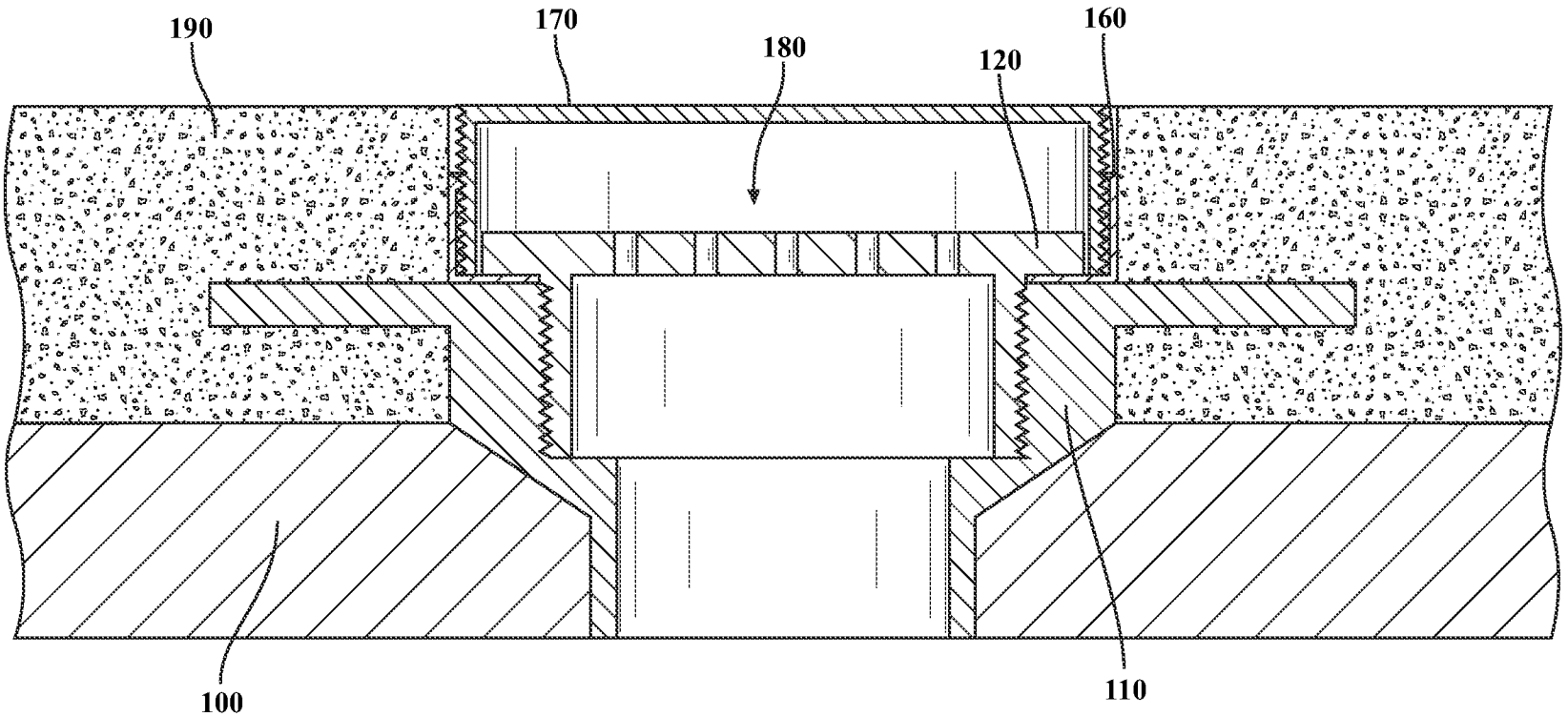

At block 710, operations 700 proceed with installing a flooring material around at least the upper portion. For example, as illustrated in FIG. 8E, flooring material 190 may be installed around upper portion 170, cover base 160, and drain/cleanout body 110. In certain aspects, flooring material 190 may be concrete that is poured and finished. In certain aspects, the closed top surface of upper portion 170 may be cut to the desired height of the finished floor level such that the floor can be leveled and finished to this surface.

Figure 8F:
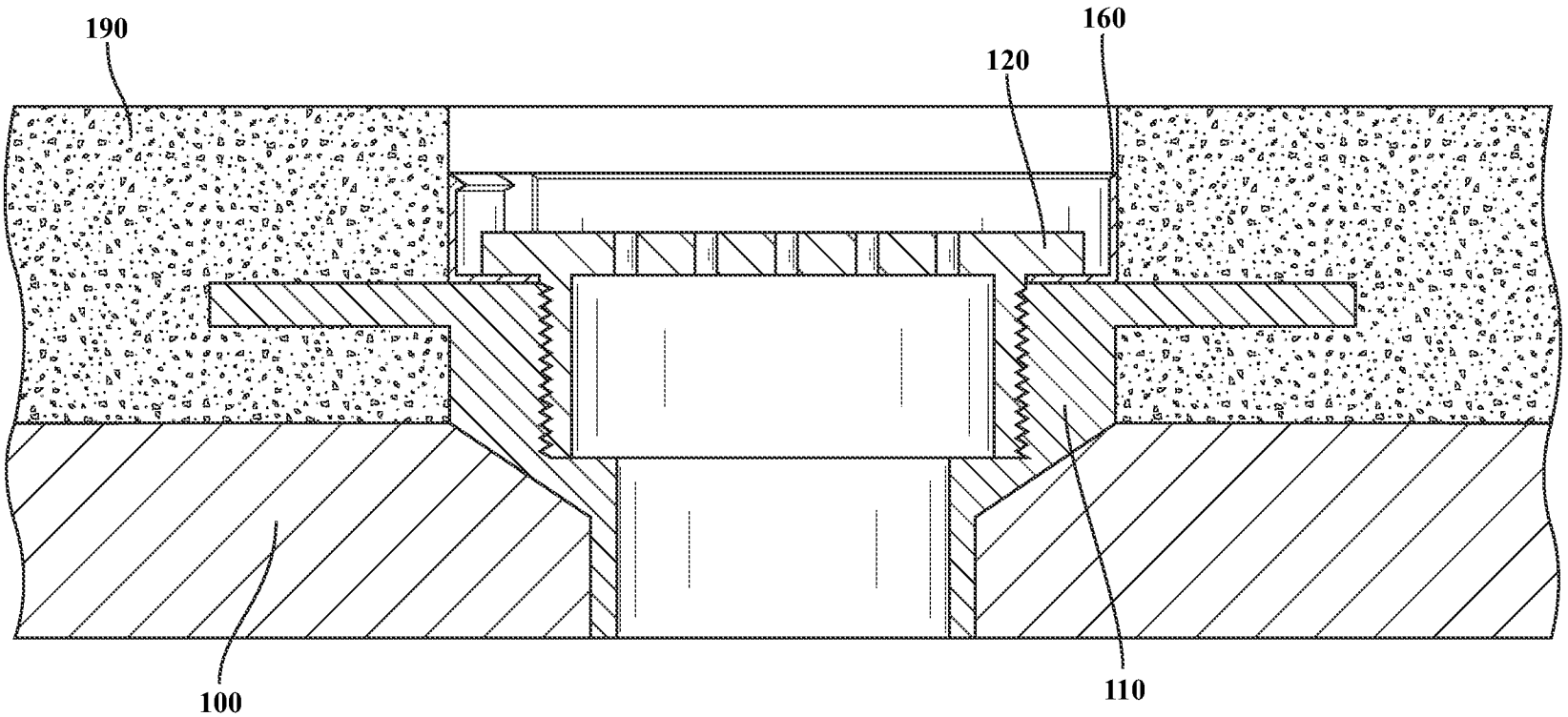

At block 712, operations 700 proceed with removing the upper portion of the drain/cleanout cover assembly from the cover base of the drain/cleanout cover assembly to expose the void space. For example, as illustrated in FIG. 8F, upper portion 170 may be removed from cover base 160 thereby exposing void space 180 above finish drain/cleanout 120. Removing upper portion 170 may include tapping and/or destruction of upper portion 170. Cover base 160 may be left in place.

Figure 8G:
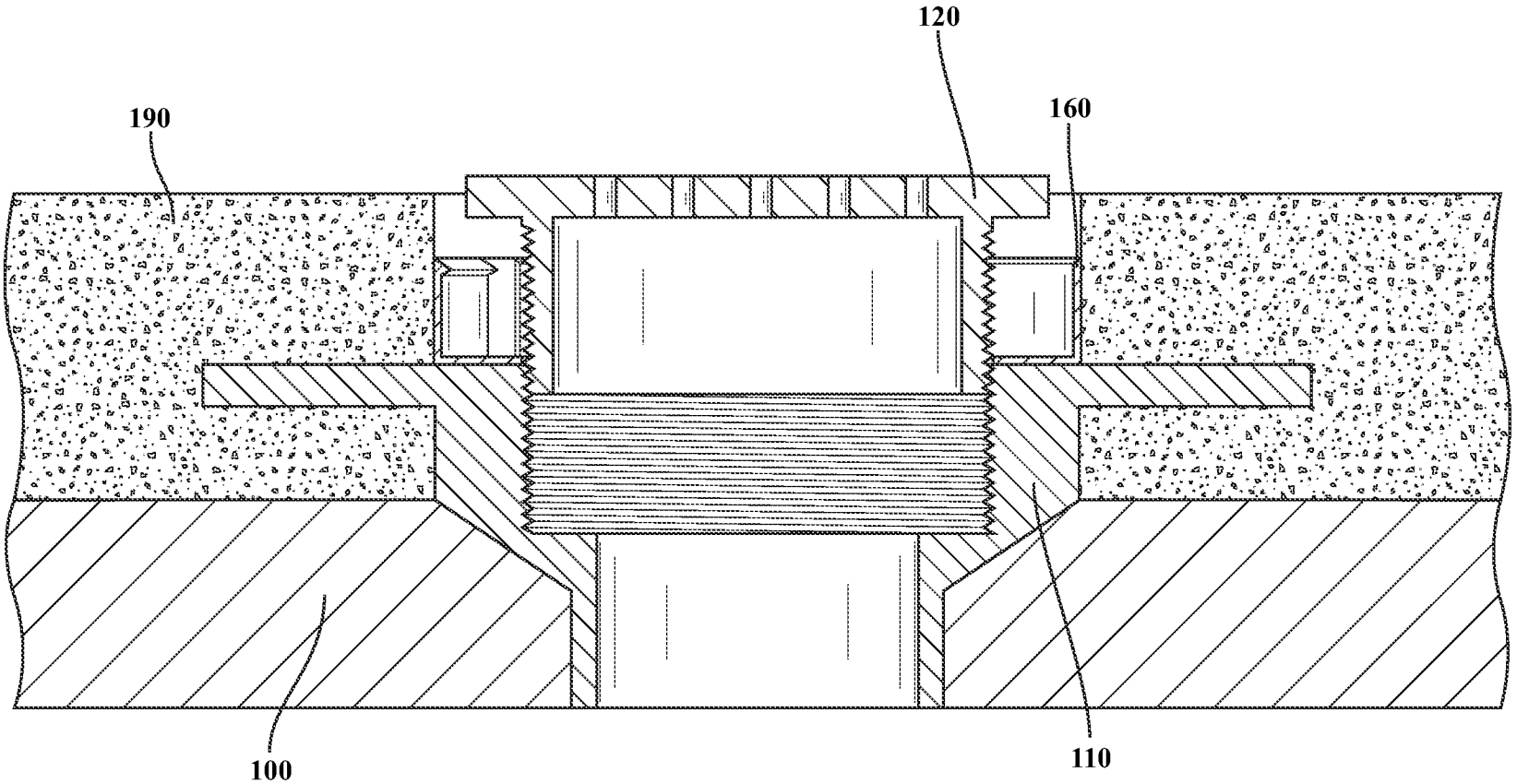

At block 714, operations 700 proceed with positioning the finish drain/cleanout at a desired height. For example, as illustrated in FIG. 8G, finish/drain cleanout 120 may be threaded vertically (e.g., unscrewed) such that top portion 122 of finish drain/cleanout 120 is no longer in contact with cover base 160. In certain aspects, finish drain/cleanout may be positioned at a height of flooring material 190 installed at block 710. In certain other aspects, finish drain/cleanout 120 may be positioned at a height greater than the height of flooring material 190 installed at block 710.

Figure 8H:
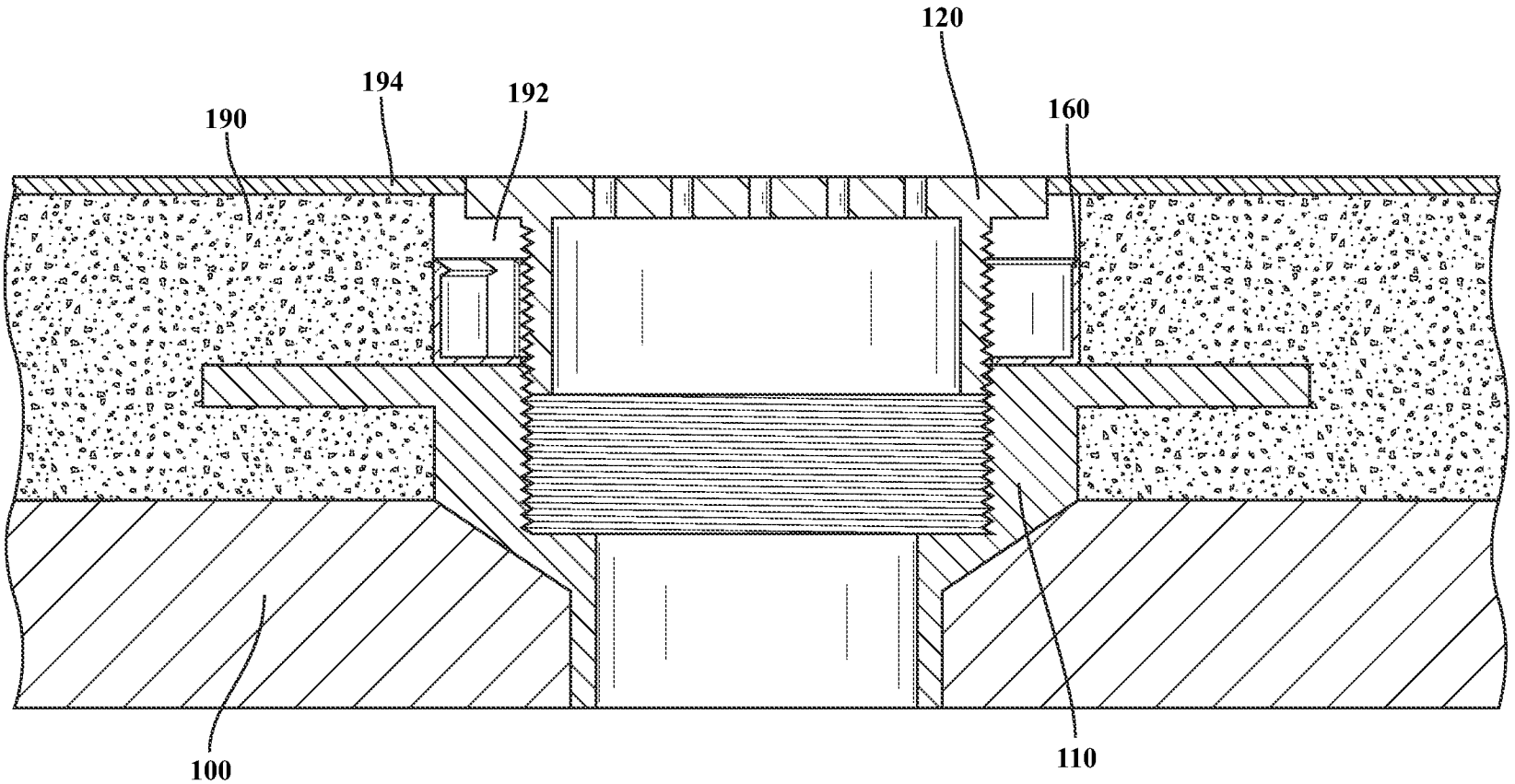

Optionally, in some cases at block 716, operations 700 proceed with filling the void space (e.g., remaining void space for which finish/drain/cleanout 120 does not fill) with a finishing material subsequent to positioning the finish drain/cleanout at the desired height. For example, as illustrated in FIG. 8H, the remaining void space may be filled with a finish material 192. In certain aspects, finishing material 192 is a self-leveling grout.

Optionally, in some cases at block 718, operations 700 proceed with installing a floor covering at a height equal to the desired height of the finish drain/cleanout subsequent to filling the void space with the finishing material. For example, as illustrated in FIG. 8H, a floor covering 194 may be installed. In certain aspects, floor covering 194 is a vinyl flooring and/or other material positioned over the flooring material 190 (e.g., concrete). Accordingly, finish drain/cleanout 120 may be flush with the surface of floor covering 194.

The present invention has been discussed primarily with reference to drain structures. As will be clear to those of skill in the art, the invention also applies to cleanouts. A cleanout is structurally similar to a drain but the upper portion lacks drain holes. The cleanout has a body like with a drain and an upper portion that typically screws into the body. The upper portion of the cleanout is removed to access the drain pipe below the cleanout.

As will be clear to those of skill in the art, the embodiments of the inventive apparatus and method disclosed herein may be altered in various ways without departing from the scope or teaching of the present invention. As such, this disclosure should be interpreted broadly.

What is claimed is:

1. A method of installing a floor drain/cleanout, comprising:

positioning a drain/cleanout body comprising a first opening for receiving a finish drain/cleanout;

disposing, on the drain/cleanout body, a cover base of a drain/cleanout cover assembly comprising a second opening for receiving the finish drain/cleanout, wherein a center of the second opening of the cover base is aligned with a center of the first opening of the drain/cleanout body;

threading the finish drain/cleanout through the first opening and the second opening to retain the cover base on the drain/cleanout body;

engaging an upper portion of the drain/cleanout cover assembly with the cover base of the drain/cleanout cover assembly, wherein engaging the upper portion with the cover base defines an enclosed void space above the finish drain/cleanout;

installing a flooring material around at least the upper portion;

removing the upper portion of the drain/cleanout cover assembly from the cover base of the drain/cleanout cover assembly to expose the void space; and positioning the finish drain/cleanout at a desired height.

2. The method of claim 1, wherein the cover base is disposed on the drain/cleanout body with a bottom surface of the cover base adjacent to a top surface of the drain/cleanout body.

3. The method of claim 1, wherein:

the finish drain/cleanout comprises:

a top portion spanning a first distance; and a generally cylindrical threaded portion spanning a second distance less than the first distance and extending vertically downward from the top portion; and threading the finish drain/cleanout through the first opening and the second opening to retain the cover base on the drain/cleanout body comprises threading the threaded portion of the finish drain/cleanout through the first opening and the second opening until a bottom surface of the top portion of the finish drain/cleanout comes in contact with a top side of a bottom surface of the cover base.

4. The method of claim 1, further comprising:

cutting the upper portion of the drain/cleanout cover assembly to the desired height prior to engaging the upper portion with the cover base of the drain/cleanout cover assembly.

5. The method of claim 1, wherein:

the cover base comprises:

a generally flat bottom surface, and a first side wall around a perimeter of the bottom surface and extending vertically upward from the bottom surface; and the upper portion comprises:

a top surface; and a second side wall around a perimeter of the top surface and extending vertically downward from the top surface.

6. The method of claim 5, wherein engaging the upper portion of the drain/cleanout cover assembly with the cover base of the drain/cleanout cover assembly comprises engaging at least a portion of an outer surface of the second side wall of the upper portion with at least a portion of an inner surface of the first side wall of the cover base and interconnect.

7. The method of claim 5, wherein:

the first side wall of the cover base and the second side wall of the upper portion are generally cylindrical;

an outer surface of the second side wall comprises a plurality of circumferential grooves extending along at least a portion of the outer surface of the second side wall; and the plurality of circumferential grooves extending along at least the portion of the outer surface of the second side wall are interrupted by one or more relieved portions.

8. The method of claim 7, wherein engaging the upper portion of the drain/cleanout cover assembly with the cover base of the drain/cleanout cover assembly comprises engaging the plurality of circumferential grooves with at least a portion of an inner surface of the first side wall of the cover base.

9. The method of claim 7, wherein engaging the upper portion of the drain/cleanout cover assembly with the cover base of the drain/cleanout cover assembly comprises engaging at least one protrusion extending inwardly from an inner surface of the first side wall of the cover base with at least one groove of the plurality of circumferential grooves of the second side wall of the upper portion.

10. The method of claim 9, wherein aligning the at least one protrusion of the cover base with the at least one groove of the upper portion comprises:

aligning a center of the cover base with a center of the upper portion; and rotating the upper portion about a vertical axis until at least one relieved portion of the upper portion aligns with the at least one protrusion;

passing the at least one protrusion through the at least one relieved portion; and rotating the upper portion about the vertical axis until the at least one protrusion of the first side wall of the cover base engages with the at least one groove of the second side wall of the upper portion.

11. The method of claim 8, wherein a width of the at least one protrusion is less than or equal to a width of the at least one relieved portion.

12. The method of claim 1, further comprising:

filling the void space with a finishing material subsequent to positioning the finish drain/cleanout at the desired height.

13. The method of claim 12, wherein the finishing material comprises a self-leveling grout.

14. The method of claim 12, further comprising:

installing a floor covering at a height equal to the desired height of the finish drain/cleanout subsequent to filling the void space with the finishing material.

15. The method of claim 1, wherein the flooring material comprises concrete.

* * * * *